United States Patent [19]

Gregory

[11] Patent Number: 4,889,387

[45] Date of Patent: Dec. 26, 1989

[54] CHAIR MEMBER

[76] Inventor: Peter G. G. Gregory, 3 Kings Place, Carlingford, New South Wales, Australia

[21] Appl. No.: 336,590

[22] Filed: Apr. 10, 1989

Related U.S. Application Data

[63] Continuation of Ser. No. 174,796, filed as PCT AU87/00156 on May 25, 1987, published as WO87/07124 on Dec. 3, 1987, abandoned.

[30] Foreign Application Priority Data

May 26, 1986 [AU] Australia ..... PH6094

[51] Int. Cl.[4] ..... A47C 7/02

[52] U.S. Cl. ..... 297/458; 297/DIG. 1; 5/464

[58] Field of Search ..... 297/458, DIG. 1, 452, 297/455, 456, 313, 195; 5/436, 464, 481, DIG. 2, 432, 437, 442

[56] References Cited

U.S. PATENT DOCUMENTS

| | | | |
|---|---|---|---|
| 1,447,288 | 3/1923 | Emmerich | 5/442 |
| 1,843,893 | 2/1932 | Becher | 5/436 |
| 3,009,172 | 11/1961 | Eidam | 5/436 |
| 3,305,878 | 2/1967 | Hellbaum | 5/437 |
| 3,446,532 | 5/1969 | Cramer | 297/313 |
| 3,751,111 | 8/1973 | Taylor et al. | 297/456 |
| 4,190,697 | 2/1980 | Ahrens | 297/DIG. 1 |
| 4,265,484 | 5/1981 | Stalter | 5/481 |
| 4,521,053 | 6/1985 | de Boer | 297/313 |
| 4,522,447 | 6/1985 | Snyder et al. | 297/DIG. 1 |
| 4,589,699 | 5/1986 | Dungan | 297/313 |
| 4,650,249 | 3/1987 | Serber | 297/313 |

*Primary Examiner*—Kenneth J. Dorner
*Assistant Examiner*—Brian K. Green
*Attorney, Agent, or Firm*—Marshall, O'Toole, Gerstein, Murray & Bicknell

[57] ABSTRACT

A chair member for promoting correct posture. The chair member may form the chair seat or back rest or it may be a portable cushion. It includes a forward support portion of relatively high density resilient material and an adjacent rear support portion of relatively low density resilient material. In the seat embodiment, differential deformation of the two regions locates an occupant's ischial tuberosity behind the forward support portion which thereby resists forward movement of the sitter from the chair. The seat is preferably inclined.

6 Claims, 3 Drawing Sheets

CHAIR MEMBER

This application is a continuation of application Ser. No. 07/174, 796, filed as PCT AU87/00156 on May 25, 1987, published as WO87/07124 on Dec. 3, 1987, now abandoned.

TECHNICAL FIELD

The present invention relates to chairs and in particular to a chair which enables the occupant to be seated with correct posture.

An occupant of a chair seated with correct posture should have his back relatively straight with the spine having a slight bow at its lower portion. Correct posture can prevent and alleviate back pain.

BACKGROUND ART

One known example of a chair which positions the occupant for correct posture is a chair having a seat which slopes forward. This ensures the occupant is positioned with a straight back. To complement the sloping seat, a knee rest can be provided to prevent the occupant from sliding forwardly off the seat.

One disadvantage of this known seat is that the pressure exerted on the knees can become uncomfortable after long periods of time.

It is an object of the present invention to provide an improved chair member which substantially overcomes or ameliorates the abovementioned disadvantages.

DISCLOSURE OF THE INVENTION

According to the invention there is provided a chair member comprising the seat of a chair, the back rest of a chair or a cushion for a chair, said chair member including a forward support portion of relatively high density resilient material and an adjacent rear support portion of relatively low density resilient material, such that the weight of a person sitting on the chair causes differential deformation whereby the rear portion is deformed to an extent greater than the forward portion, said rear portion being located above said forward portion when in the use position.

The invention also provides a chair incorporating a chair member as described above, said chair member being an inclined or inclineable seat, said differential deformation locating the sitter's ischial tuberosity behind said forward support which thereby resists forward movement of the sitter from the seat.

Preferably, the chair member is incorporated as the inclined or inclineable seat of a chair as described above. However, it can also function as a portable or removable seat, cushion or back support. It may also be incorporated as a horizontal seat on a conventional chair.

Preferred embodiments of the invention will now be described, by way of example only, with reference to the accompanying drawings:

BEST MODE FOR CARRYING OUT THE INVENTION

Figure 1:
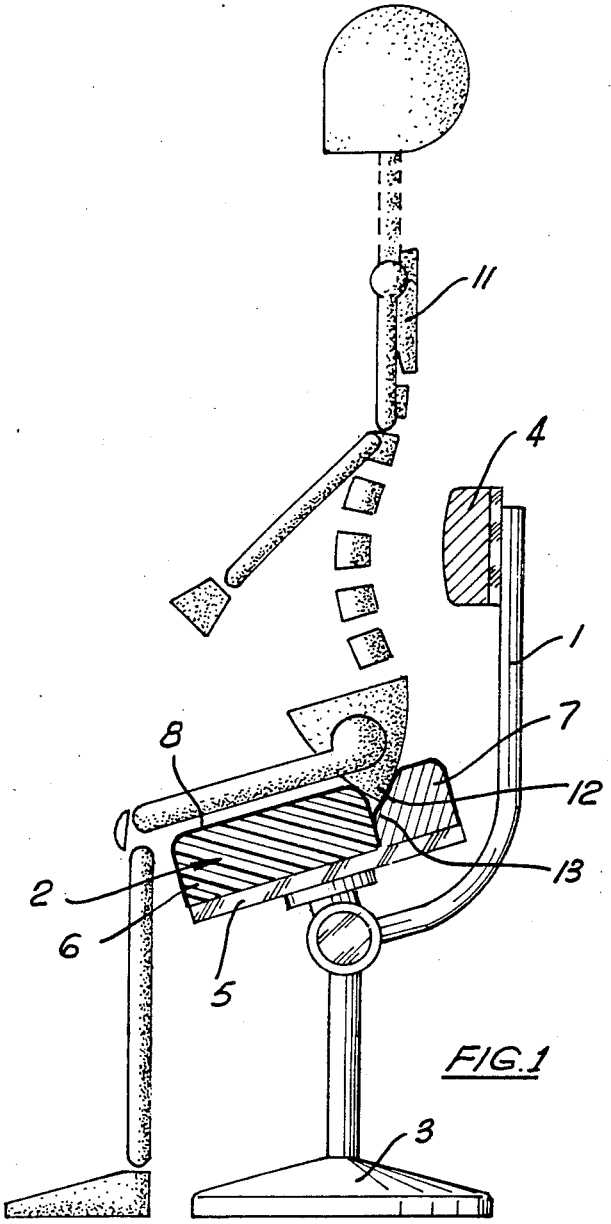
FIG. 1 is a sectional side elevation of a chair according to the invention showing a schematic skeletal occupant seated with correct posture.

Referring initially to FIG. 1 of the drawings, a chair 1 according to one embodiment of the invention comprises an inclined seat 2 fitted onto a base 3. A back rest 4 may be provided to give additional support if required. The chair 1 is adjustable in conventional fashion to provide the required height and inclination of the seat 2 and the back rest 4.

Figure 2:
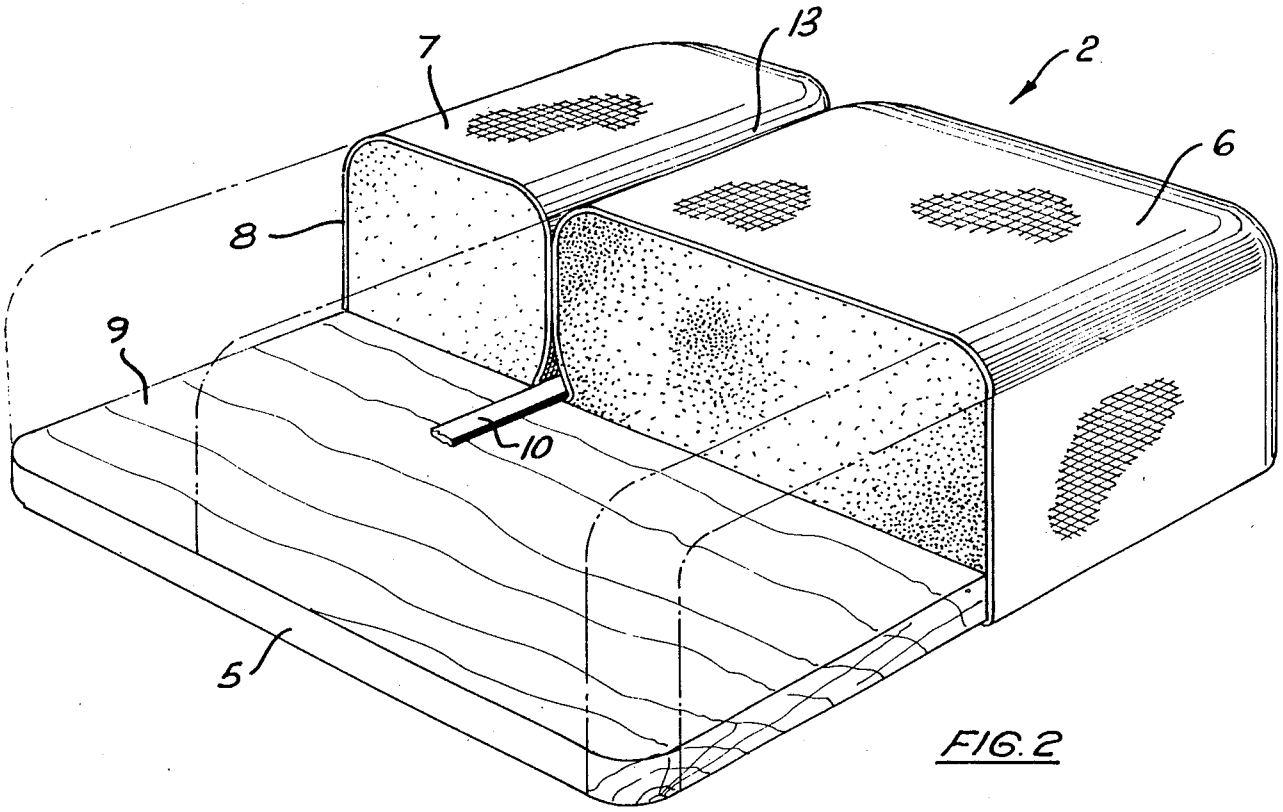
FIG. 2 is an enlarged sectional perspective view of the chair seat shown in FIG. 1.

As shown in FIGS. 1 and 2, the inclined seat includes a base 5 to which is attached a forward support portion 6 formed of relatively high density resilient plastics material. The base also supports a rear support portion 7 of relatively low density resilient plastics material located adjacent the forward support 6. In this embodiment, both support portions are separately upholstered by a suitable covering 8. The covering 8 may be a single piece of material, conveniently divided and secured to the upper surface 9 of the base 5 by a transverse bar 10.

When an occupant 11 is seated on the chair member 2, as shown in FIG. 1, the differing densities of the support portions results in differential deformation whereby the rear support portion 7 is deformed to an extent greater than the forward portion 6. This permits the occupant's ischial tuberosity 12 to be positioned behind the forward support 6, generally in the crevice 13 between the two portions. The forward support portion 6 thereby positively acts against the ischial tuberosity and comfortably resists the tendency of the sitter to slide forwardly off the seat.

Figure 3:
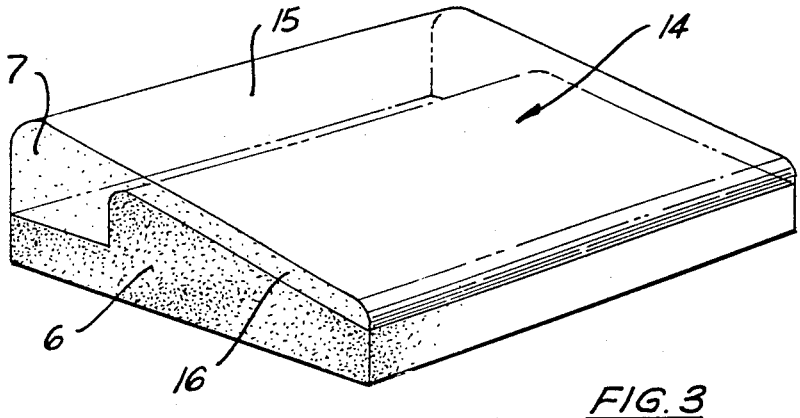
FIG. 3 is a sectional perspective view of a cushion according to the invention.

FIG. 3 shows a second embodiment of the invention in the form of a cushion 14 which may be portable and which can be placed upon a conventional horizontal bench or seat (not shown). The cushion 14 is similar to the seat 2 illustrated in FIGS. 1 and 2 but has an upper surface 15 which inclines rearwardly. The forward support portion 6 is correspondingly inclined and in this embodiment also defines a base for the cushion. The rear support portion 7 extends forwardly over the forward portion 6 to define a relatively soft and shallow covering 16 for the forward portion.

The principal of operation of the cushion 14 is the same as that of the chair 1. The cushion 14 may also be constructed in the manner shown in FIGS. 1 and 2 but with a suitably inclined upper surface.

Figure 4:
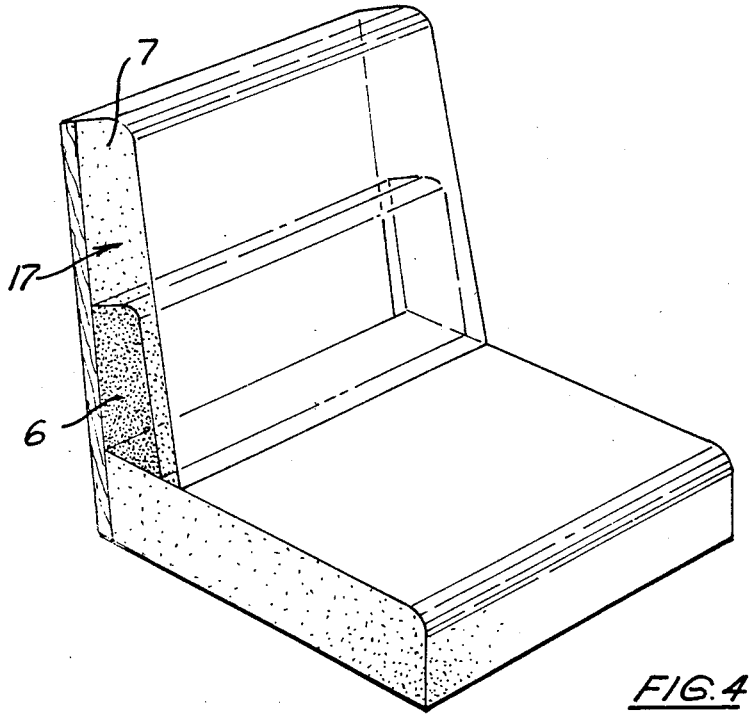
FIG. 4 is a sectional perspective view of a chair incorporating a back rest according to the invention.

Another embodiment of the invention is illustrated in FIG. 4 where the chair member 17 forms a back rest for a chair. In this embodiment, the higher density forward support portion 6 provides lower back support for the sitter, whose shoulders deform the lower density rear support portion 7 to a greater extent. As a consequence, the sitter's back is better supported and kept relatively straight. The back rest 17 can be used as part of a conventional chair or in conjunction with a seat fabricated in the manner of seat 2 or cushion 14.

Although the invention has been described with reference to specific examples, it will be appreciated by those skilled in the art that the invention may be embodied in many other forms.

I claim:

1. A chair having a seat member and a backrest for supporting a person sitting on said chair, said seat member including a forward support portion of relatively high resistance to resilient deformation and an adjacent rear support portion of relatively low resistance to resilient deformation, the forward support portion possessing a higher resistance to resilient deformation than the resistance to resilient deformation of the rear support portion, said forward and rear support portions defining a substantially transverse crevice therebetween extending substantially parallel to said backrest such that, in use, said crevice extends substantially transversely with respect to longitudinal axes of the sitter's thighs with the forward support portion substantially forward of the sitter's ischial tuberosities, such that the weight of a person sitting on the chair causes differential deformation whereby said rear support portion is deformed to an extent greater than said forward support portion thereby resiliently opening said crevice and locating the sitter's ischial tuberosities at least partly within said crevice behind said forward support portion thereby resisting forward movement of the sitter on the seat member by exerting a rearwardly directed pressure on said ischial tuberosities such that the sitter is supported in an ergonomically correct posture.

2. A chair according to claim 1 wherein said seat member is inclined.

3. A chair according to claim 1 wherein the upper surface of said rear portion is located above the upper surface of said forward portion when in the use position.

4. A chair according to claim 1 wherein said support portions are separately upholstered.

5. A chair according to claim 1 wherein said forward support portion is covered by a relatively shallow layer of relatively soft material.

6. A chair according to claim 1 wherein one of said support portions has an upper surface which in use inclines with respect to the horizontal.

* * * * *